US006095214A

United States Patent [19]

Gaffney

[11] Patent Number: 6,095,214

[45] Date of Patent: Aug. 1, 2000

[54] GOLF CLUB HEAD COVER

[76] Inventor: John H. Gaffney, 6020 E. Cholla La., Scottsdale, Ariz. 85253

[21] Appl. No.: 09/086,018

[22] Filed: May 28, 1998

[51] Int. Cl.[7] ..... B65D 65/02

[52] U.S. Cl. ..... 150/160; 206/315.4

[58] Field of Search ..... 150/159, 160; 206/315.2, 315.4

[56] References Cited

U.S. PATENT DOCUMENTS

| | | | |
|---|---|---|---|
| 3,133,577 | 5/1964 | Bellevue, Sr. | 150/160 |
| 3,478,799 | 11/1969 | Holt, Jr. | 150/160 |
| 3,548,908 | 12/1970 | Koehing . | |
| 3,593,769 | 7/1971 | Spears | 150/160 |
| 3,727,659 | 4/1973 | Shuford | 150/160 |
| 4,667,716 | 5/1987 | Solheim et al. | 150/160 |
| 5,117,884 | 6/1992 | Diener et al. | 150/160 |
| 5,284,194 | 2/1994 | Gaffney | 190/160 |
| 5,294,127 | 3/1994 | Keelan | 150/160 X |
| 5,345,987 | 9/1994 | Hagar | 150/160 |
| 5,403,009 | 4/1995 | Gleason, Jr. | 150/160 X |
| 5,522,592 | 6/1996 | Evelsizer, Jr. | 150/160 |
| 5,547,193 | 8/1996 | Sander | 150/160 X |
| 5,615,720 | 4/1997 | O'Sullivan | 150/160 |
| 5,738,157 | 4/1998 | Gaffney | 150/160 |

FOREIGN PATENT DOCUMENTS

| | | | |
|---|---|---|---|
| 2233239 | 1/1991 | United Kingdom | 150/160 |

*Primary Examiner*—Sue A. Weaver
*Attorney, Agent, or Firm*—LaValle D. Ptak

[57] ABSTRACT

A golf club head cover is made primarily of stretchable fabric, which is in the shape of an elongated cylinder closed at the upper end and open at the lower end. The stretch fabric is made to stretch in a circumferential direction of the cover. The open lower end of the cover has dimensions which are smaller than the dimensions of a golf club head with which the cover is to be used; so that the cover stretches as the head is inserted. To facilitate placement of the cover over a golf club head, the lower open end of the cover has a pair of diametrically opposed lips extending from it. The lips are joined together at notches on diametrically opposite sides of the lips to facilitate use of the lips in placing the cover over a golf club head. The cover stretches to conform to the shape of the head, thereby protecting the head when it is inserted into the cover.

17 Claims, 2 Drawing Sheets

FIG. 1
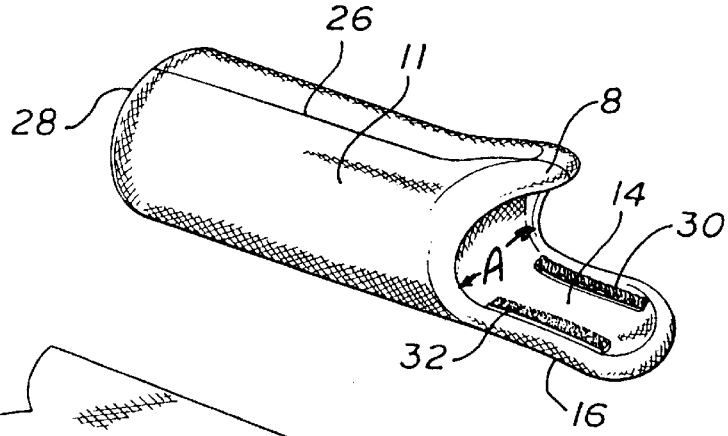
FIG. 2
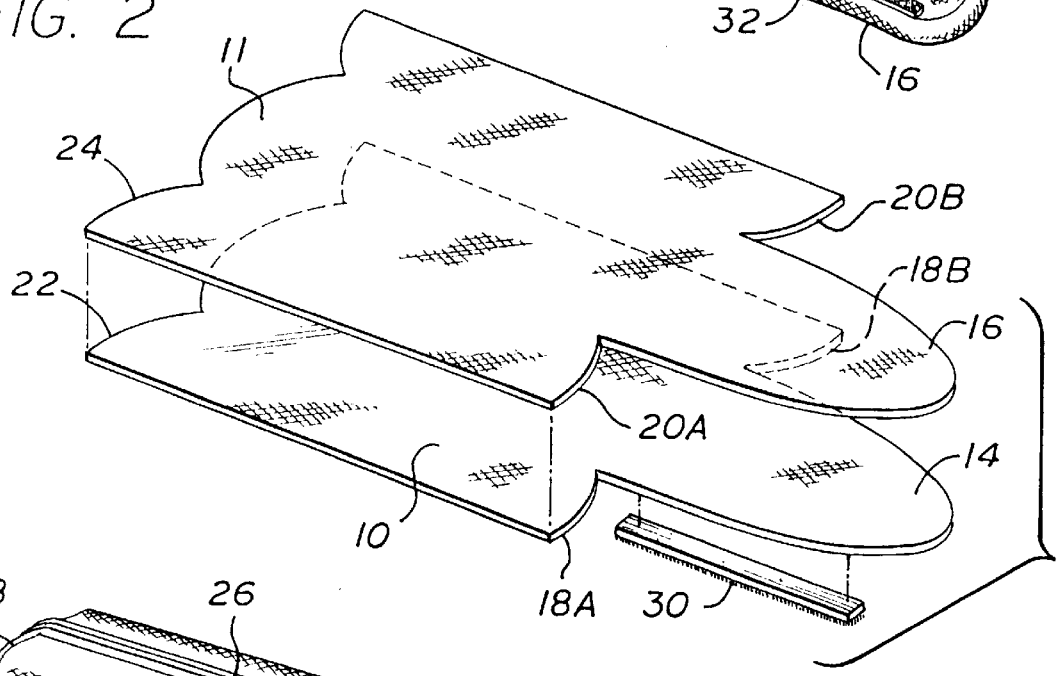
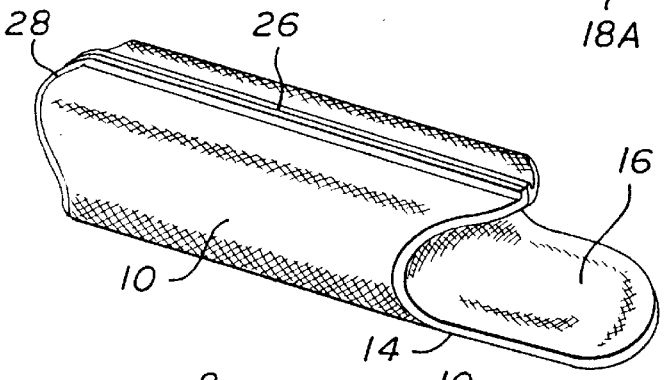
FIG. 3
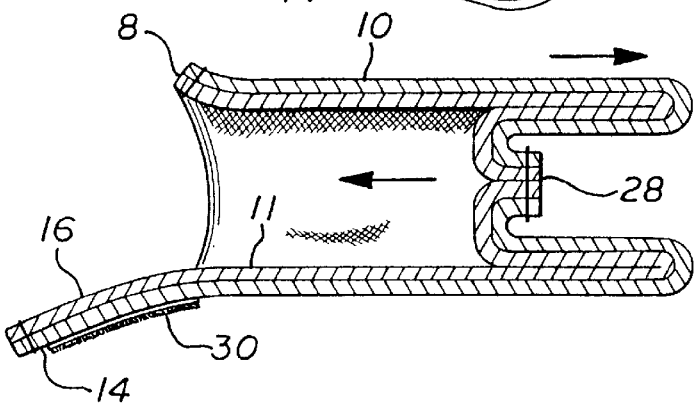
FIG. 4A

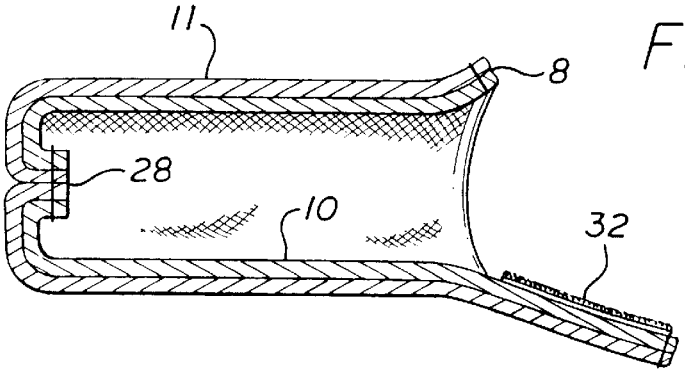
FIG. 4B
FIG. 6
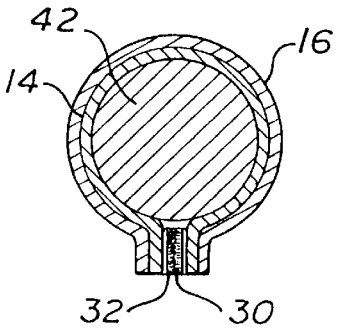
FIG. 5A
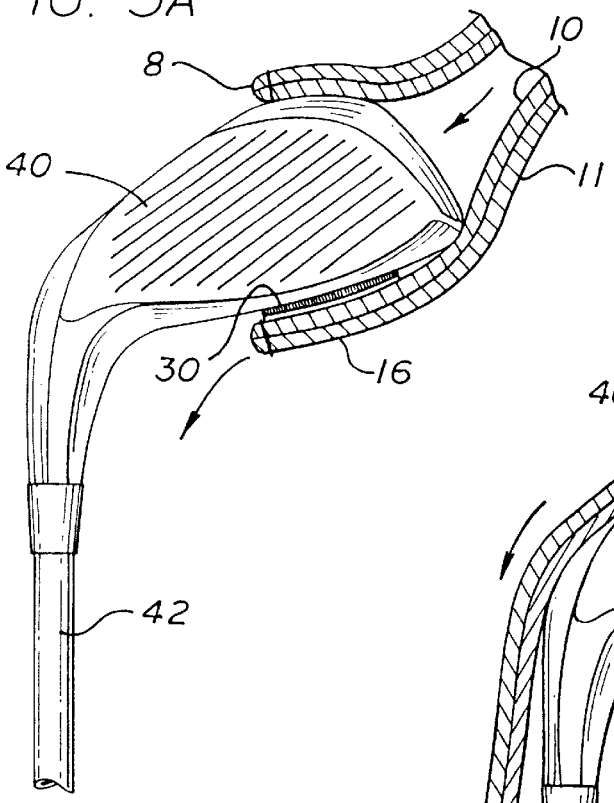
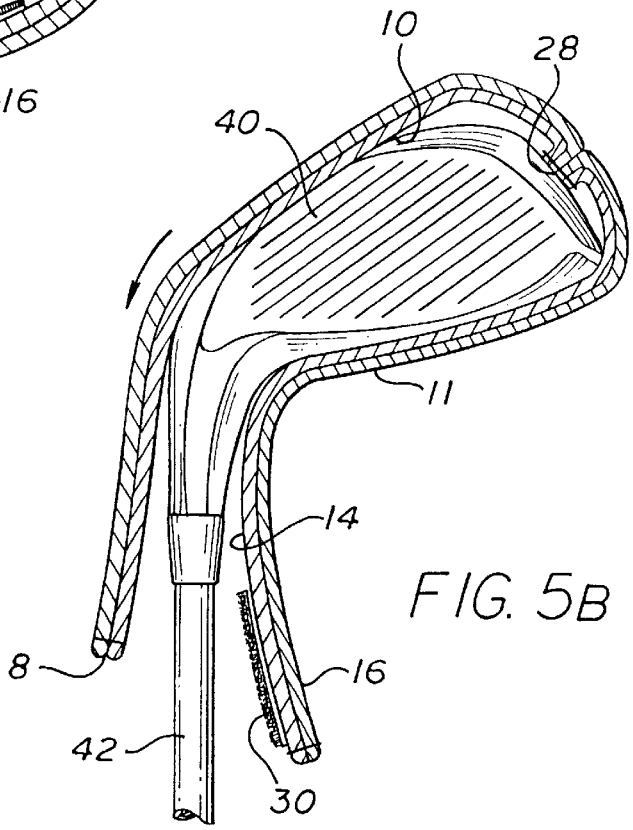
FIG. 5B

GOLF CLUB HEAD COVER

BACKGROUND

Padded covers have been used for a number of years to protect the heads of golf clubs from banging into one another when they are carried in a golf bag. Typically, these head covers are made of soft, padded, bulky material and extend around the head and a relatively short distance over the end of the shaft, where the shaft is attached to the head. These head covers are closed at the top end (when the club is in the bag) and are open at the lower end, from which the shaft extends. The opening is relatively wide and permits easy placement of the cover on the golf club head, and easy removal of the cover from the club head when that particular club is desired for use in the play of the game of golf.

Head covers of the type described above have been considered adequate for most golf clubs. With the advent of large oversized driver "woods", however, heads constructed in this manner tend to become extremely bulky and occupy far more space than desirable. For oversized large drivers, head covers constructed in the conventional manner must be of relatively large diameter, with a large opening on the lower or open end to facilitate placement of the cover on the head and enable easy removal of the cover when the use of the club is desired. Since golfers typically use more than one wood or driver in the bag of clubs, large bulky head covers constitute a problem in their competition for space in the limited area which is available.

In addition to the bulk which results from conventional padded head covers, head covers of different sizes must be used for the club heads of corresponding different sizes. Thus, a head cover which is designed for a relatively small golf club head cannot be used for a large driver. If a head cover designed for a large driver is used on a golf club head which is relatively small, the oversized head cover does not fit snugly enough and is loose and easily dislodged.

Efforts to provide covers which conform to different shapes of golf club heads are disclosed in the United States patents to Shuford U.S. Pat. No. 3,727,659 and Diener U.S. Pat. No. 5,117,884. Both of these patents disclose golf club head covers which are made of resilient or stretch types of material. The cover of the Shuford is simply an elongated knit stocking of a cylindrical configuration. This stocking then is tied or otherwise closed at the upper end; and it then can be stretched over the club head by inserting a club through the other open end.

The cover of the Diener patent is made of a one piece molded flexible plastic material. The end into which the club head extends is molded to fit over a particular size and shape of golf club head. The molded head portion then is attached to an integral skirt portion, which is designed to de-form and then return to its original shape upon the insertion and removal of a golf club head. Molded plastic is used to form this cover. It is not made of soft resilient fabric.

Another effort to provide a close fitting and yet easily applied golf club head cover is disclosed in the patent to Koetting U.S. Pat. No. 3,548,908. This patent discloses a golf club cover having a head portion and two non-extendable parts extending downwardly from the head portion on opposite sides of a golf club shaft. These two non-extendable parts are connected to strips of elastic material on each side; so that the elastic is stretched to allow the cover to placed onto or removed from a golf club head.

A different approach to facilitating the placement of a cover on a golf club head is shown in the patent to Bellevue U.S. Pat. No. 3,133,577. This cover incorporates a gripping lip or extension on the open end of the cover. The cover of the Bellevue patent, however, is not made of stretch material; so that the lip feature functions simply as a handle to assist the user in placing the cover on a golf club head.

Knitted covers of material of the type similar to knit socks for personal wear could be used to provide a stretchable cover which fits over golf club heads of various sizes. The covering thickness of such a cover, however, is relatively thin, and does not provide the degree of padded protection for the club head which most golfers desire. The "look" and protection provided by padded head covers which are in widespread use is considered by most golfers to be the standard; and anything which does not have the protection and thickness of such padded covers is not considered adequate by most golfers.

It is desirable to provide a padded golf club head cover which is relatively universal in its application and which conforms to the shape of various golf club heads, from large drivers to smaller irons, and which provides the padded appearance and protection of prior art covers while also being easy to apply and remove.

SUMMARY OF THE INVENTION

It is an object of this invention to provide an improved golf club head cover.

It is another object of this invention to provide an improved golf club head cover which may be used to cover golf club heads of various sizes.

It is an additional object of this invention to provide an improved golf club head cover which facilitates insertion of a golf club head into the cover and facilitates removal of the golf club head from the cover.

It is a further object of this invention to provide an improved golf club head cover which is universal for application to heads of a variety of sizes and which stretches to conform to the shape of different golf club heads while being easy to apply and remove from the golf club head.

In a preferred embodiment of this invention, the golf club head cover is constructed as a generally hollow, cylindrically shaped cover for the head of a golf club. The head cover itself comprises an inner lining and an outer bulky material made at least in part with elasticity in the circumferential direction to stretch around a golf club head as the cover is placed over the head. To facilitate insertion of a head, the head cover is open at its lower end and has first and second elongated lips or flaps which are joined together at notches on diametrically opposite sides of the open lower end. The cover stretches around the head to protect the head when it is stored in a golf bag along with other golf clubs.

BRIEF DESCRIPTION OF THE DRAWINGS

FIG. 1 is a perspective view of a preferred embodiment of the invention;

FIG. 2 is an exploded view of various parts of the embodiment shown in FIG. 1;

FIG. 3 is a perspective view of the cover of FIG. 1 at an intermediate step of its manufacture;

FIG. 4A illustrates another step of the manufacture of the head cover of FIG. 1;

FIG. 4B illustrates a cross-sectional view of the head cover shown in FIG. 1;

FIGS. 5A and 5B illustrate the manner of inserting a golf club head into the head cover shown in FIG. 1; and FIG. 6 is a cross-sectional view of a portion of the head cover of FIG. 1 illustrating a feature in the use of the preferred embodiment of the invention.

DETAILED DESCRIPTION

Reference now should be made to the drawings, in which the same reference numbers are used throughout the different figures to designate the same components.

FIG. 1 is a perspective view of a preferred embodiment of the invention. This figure shows a universal golf club head cover in the form of an elongated closed cylinder having an exterior plush stretch fabric portion 11 and an interior stretch liner 10. The upper end of the head cover is closed at a seam 28; and the cover portions themselves are brought together in an elongated seam 26, as shown in FIG. 1. At the lower or open end of the head cover, a pair of diametrically opposed elongated lips or flaps 8 and 14/16 are formed. These lips are joined together at diametrically opposed notches at the ends of a line "A" as indicated in FIGS. 1 and 2. The elongated lip 14/16 has a pair of mating hook-and-loop fasteners, which may be VELCRO® hook-and-loop portions 30 and 32, sewn along opposite sides of the lining surface 14 of the elongated lip 14/16 of the head cover shown in FIG. 1.

The head cover of FIG. 1 is assembled from the parts shown in FIG. 2. The outer plush stretch fabric portion 11 is made from a sheet of cut pile fur-like material, preferably sliver knit acrylic fiber with Lycra® and polyester backing, which includes elastic stretch fibers in at least the transverse direction shown in FIG. 2. This is the circumferential direction in FIG. 1. An inner lining portion also is formed of a cushioned pile elastic stretch fabric sheet 10 having the same configuration as the sheet 11. As illustrated in FIG. 2, the edges of the sheets 10 and 11 which form the closed top of the head cover of FIG. 1 comprise edges 22 and 24, respectively, and the portions of the inner liner sheet 10, which form the insides of the extending lips of the device of FIG. 1, comprise an elongated tongue 14 and a pair of shorter curved portions 18A and 18B. Similarly, the outer layer has an elongated tongue 16 and a pair of shorter tongues or lip portions 20A and 20B.

Elongated hook-and-loop fastener strips 30 and 32 are attached to the bottom side (as viewed in FIG. 1) of the inner liner portion 10, as shown in FIG. 2. Once the parts of FIG. 2 have been joined together at the edges and the strips 30 and 32 have been attached, the assembly is rolled to bring the straight elongated edges of the parts 10/11 together. These edges are sewn together along a seam 26, as illustrated in FIG. 3. The portions 22 and 24 then are sewn together to close the upper top at a seam 28, as illustrated in FIGS. 1 and 3. This is the partially finished structure of the head cover.

Once the structure has been assembled as shown in FIG. 3, it is inside-out, namely the inner liner portion 10 is on the outside and the portion 11, which ultimately is to become the outside of the device, is located on the inside. To orient the head cover in its proper configuration as shown in FIG. 1, it is turned inside-out, as illustrated in FIG. 4A by pulling the end with the seam 28 back through the assembled inside-out head cover open end between the lips 8 and 14/16, as shown in FIG. 4A. When the entire head cover has been turned inside-out as shown in FIG. 4B, the desired finished plush surface 11 is on the exterior. The strips 30 and 32 then are located on the upper (as viewed in FIG. 4B) surface of the lip 14.

When the head cover is to be placed on a golf club head, such as the golf club head 40 of FIG. 5A, the head 40 is inserted into the open end of the cover, as shown in FIG. 5A, by pulling on the lip portion 14/16 in the direction of the arrow shown in FIG. 5A. This causes the stretchable fabric of the liner 10 and exterior portions 11 to pull over and to be conformed to the shape of the golf club head. By causing the open end of the cover to have the extending lips 8 and 14/16, as shown most clearly in FIGS. 1 and 4B, the cover is permitted to undergo a substantial stretch at the notches at the ends of the line "A" shown in FIG. 1, even if little or no stretching of the cover in the elongated direction (along the axis of the cylinder) takes place. In addition, by utilizing the notches found at the ends of the line "A" shown in FIG. 1, the opening in the lower end of the cover can be considerably smaller than the actual size of a golf club head inserted into it, and still permit relatively easy insertion of the golf club head in the manner shown in FIG. 5A.

FIG. 5B shows the cover fully pulled over the golf club head, with the lips 8 and 14/16 extending downwardly past the hosel of the club, and the lip 14 extending downwardly along the shaft 42. The sides of the lip 14/16 may be pressed around the shaft 42; so that the hook-and-loop fastener members 30 and 32 engage on opposite sides of the shaft 42 to hold the lip 16 tightly engaged around the shaft 42. This protection of the shaft 42 is shown in the cross-sectional view of FIG. 6, which indicates the manner in which the various parts are oriented in this part of the lip.

Also as shown in FIG. 5B, the cover conforms to the outer configuration of the golf club head 40 and follows the configuration of the head around the hosel and the shaft 42, as illustrated. Consequently, even though a thickness of material on the order of from ¼" to ½" overall thickness is used for the two layers 10 and 11, the bulk of the cover is significantly reduced from the standard mushroom-type cylindrical covers previously used.

The foregoing description of the embodiment shown in FIGS. 1 through 6 employs a single piece of plush stretch material 11 on the outer surface of the head cover. An alternative version of the head cover can employ plush stretch fabric on less than the entire exterior of the head cover. For example, the upper half of the cover shown in FIG. 1 extending from the lip 8 to the seam 28 could be made of leather or other non-stretchable material to provide a contrasting look and to provide a smooth surface for embroidering of names and logos, if desired. It is important, however that at least the lower half of the outer material 11 adjacent the elongated lip 14/16 be made of stretch material; so that the cover can be stretched across the notch or dimension "A", in the manner described previously, to fit over heads of various sizes. Obviously, if a portion (up to one-half) of the outer cover material 11 is not made of stretch material, the overall stretchability of the cover is limited to the portion of the outer material 11 which is permitted to stretch.

It also should be noted that while the lips 8 and 14/16 are shown with a generally curved or circular configuration, these lips also may be flat across the outermost edges. It is important for such a configuration, however, that the notch at the line "A" shown in FIGS. 1 and 2 be provided; so that the short lip and the longer lip extend beyond this notch. The notch then provides the desired amount of stretching to permit the cover to be pulled over oversized clubs, even though the stitching at the end of a squared-off or flat lip limits or prevents any stretching along the line of the seam made by the stitching. The lips 8 and 14/16 also both may be of the same length (either long or short), if desired.

The foregoing description of the preferred embodiments of the invention is to be considered as illustrative and not as limiting. Various changes and modifications will occur to those skilled in the art for performing substantially the same function, in substantially the same way, to achieve substantially the same result, without departing from the true scope of the invention as defined in the appended claims.

What is claimed is:

1. A golf club head cover including in combination:

inner and outer layers of flexible material formed into a hollow, generally cylindrically shaped head cover having upper and lower ends, said upper end being closed and said lower end being open, said inner and at least a substantial portion of said outer layer being made of elastic material to stretch in at least a circumferential direction of said cylindrically shaped head cover; and diametrically opposed first and second lips integrally formed from said inner and said outer layers of flexible material of said head cover, and extending beyond and attached to the open lower end of said head cover, said lips joined together at diametrically opposed notches on the lower end of said head cover.

2. The combination according to claim 1 wherein said first lip is greater in length than said second lip.

3. The combination according to claim 2 further including a closure device on said first lip for closing said lip around the shaft of a golf club.

4. The combination according to claim 3 wherein said closure device comprises first and second strips of hook-and-loop fasteners located along opposing edges of said first lip.

5. The combination according to claim 2 wherein said substantial portion of said outer layer of flexible material is made of stretch material between said diametrically opposed notches.

6. The combination according to claim 5 wherein the distance across said open end of said head cover between said notches is selected to be less than the dimension of a golf club head to be inserted into said head cover.

7. The combination according to claim 6 further including a closure device on said first lip for closing said lip around the shaft of a golf club.

8. The combination according to claim 7 wherein said closure device comprises first and second strips of hook-and-loop fasteners located along opposing edges of said first lip.

9. The combination according to claim 8 wherein said outer layer of flexible material is sheared plush material.

10. The combination according to claim 9 wherein the combined thickness of said inner and outer layers of flexible material is between ¼" and ½".

11. The combination according to claim 10 wherein said first and second lips have a curved configuration.

12. The combination according to claim 1 wherein the distance across said open end of said head cover between said notches is selected to be less than the dimension of a golf club head to be inserted into said head cover.

13. The combination according to claim 12 wherein said substantial portion of said outer layer of flexible material is made of stretch material between said diametrically opposed notches.

14. The combination according to claim 1 wherein said first and second lips have a curved configuration.

15. The combination according to claim 1 wherein said outer layer of flexible material is sheared plush material.

16. The combination according to claim 1 wherein the combined thickness of said inner and outer layers of flexible material is between ¼" and ½".

17. The combination according to claim 1 wherein said substantial portion of said outer layer of flexible material is made of stretch material between said diametrically opposed notches.

* * * * *